United States Patent [19]

Santo

[11] 4,114,215

[45] Sep. 19, 1978

[54] UNITARY ACCESSORY CONTROL FOR A WATERBED

[76] Inventor: Philip J. Santo, 130 Larkspur La., Rochester, N.Y. 14622

[21] Appl. No.: 814,205

[22] Filed: Jul. 11, 1977

[51] Int. Cl.[2] ..... A47C 21/08; A47C 27/08

[52] U.S. Cl. ..... 5/370; 5/317 R; 5/284; 128/33

[58] Field of Search ..... 5/279 R, 284, 317 R, 5/368–371; 128/33

[56] References Cited

U.S. PATENT DOCUMENTS

| | | | |
|---|---|---|---|
| 3,746,835 | 7/1973 | Yu et al. | 5/370 |
| 3,778,852 | 12/1973 | Penn et al. | 5/370 |
| 3,840,924 | 10/1974 | Hamilton | 5/317 R |
| 3,872,526 | 3/1975 | Betts | 5/370 |
| 3,879,598 | 4/1975 | Darling | 5/371 |

*Primary Examiner*—Casmir A. Nunberg
*Attorney, Agent, or Firm*—Lawrence P. Kessler

[57] ABSTRACT

A unitary accessory control for a waterbed fixed to the waterbed frame. Within the unitary accessory control are such accessories as a pump for filling (emptying) the waterbed, a heater, a vibrator, a sound system and a mechanism to control the environment of the room in which the waterbed is located. The user can thus regulate to his taste, the temperature and degree of motion of his sleep surface, and even change these variables at will. Additionally, he may create a total surrounding environment completely of his own choosing as to sound and/or room lighting and temperature without moving from his sleep surface.

7 Claims, 3 Drawing Figures

UNITARY ACCESSORY CONTROL FOR A WATERBED

BACKGROUND OF THE INVENTION

1. Field of the Invention

This invention relates generally to floatation type body support systems, and more particularly to a unitary accessory control for a waterbed.

2. Description of the Prior Art

In a time when scientific progress touches our lives every day in many varied ways, one fundamental area of concern remains substantially untouched; that is the surface upon which we sleep. Progression from the straw mat to the stuffed mattress to the inner spring mattress was more evolutionary than inventive. Little real effort has been directed at evaluating the fundamental principles necessary to improve the basic quality of the rest obtained on the common sleep surface.

Recently, however, medical studies have recognized that floatation type body support systems provide an effective alternative to other known sleep surfaces. The studies were originally directed to preventing decubitus ulcerations (commonly called bed sores) in bedridden patients. Since it was considered that the sores were caused by pressure points between the body and its support surface, it was felt that an equalized pressure distribution would elevate the local pressure points. A floatation type body support system was found to accomplish such pressure distribution. Moreover, it was determined that in addition to relieving the occurrence of bed sores, the quality of the rest which the patients enjoyed was markedly improved.

After it was realized that the improved quality of rest generated by the floatation type body support systems had practical universal application, this sleep surface, now known commonly as the waterbed, was made widely available to the general public. With the knowledge that approximately one-third of the life of an average adult is spent in the bedroom, efforts have been made to improve the already superior rest giving qualities of the waterbed. Any such improvement has marked benefits since it has been shown that both physical and mental well being are aided by ample rest periods. Some attempted improvements have included heating the fluid within the waterbed (see U.S. Pat. No. 3,585,356), or causing the fluid to vibrate (see U.S. Pat. No. 3,872,526). There has, however, been no attempt to completely assess all the variables effecting rest, nor any mechanism variables to his individual taste.

SUMMARY OF THE INVENTION

In accordance with the present invention there is provided a unitary accessory control attached to the waterbed frame. The unitary accessory control places at the fingertips of the user of the waterbed all of the functions necessary to expand the rest giving qualities of the basic waterbed. Within the unitary accessory control are such accessories as a pump for filling (emptying) the waterbed, a vibrator, a sound system and a mechanism to control the environment of the room in which the waterbed is located. The user can thus regulate to his taste the temperature and degree of motion of his sleep surface, and even change these variables at will. Additionally, he may create a total surrounding environment completely of his own choosing as to sound and/or room lighting and temperature without moving from his sleep surface.

DESCRIPTION OF THE PREFERRED EMBODIMENT

Figure 1:
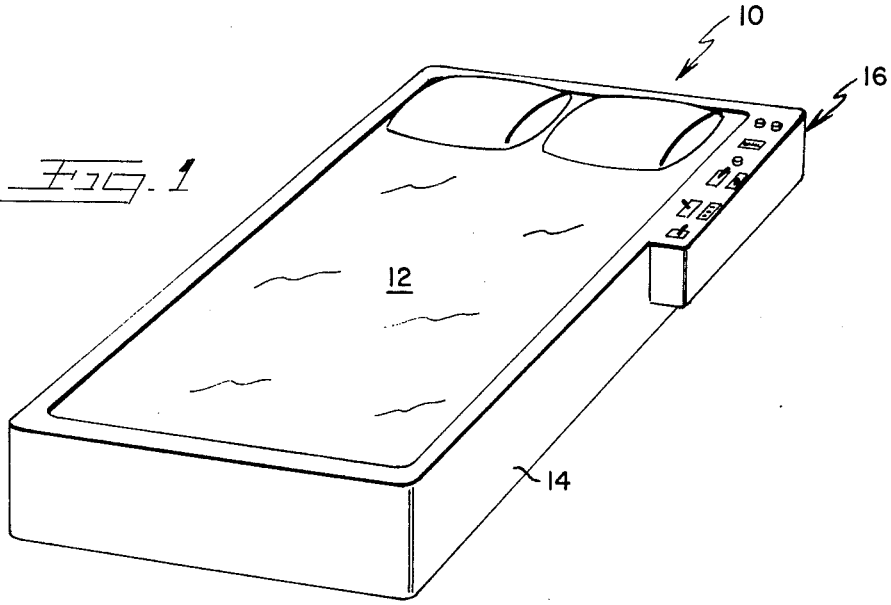
FIG. 1 is a perspective view of a waterbed incorporating the unitary accessory control of this invention.
Figure 2:
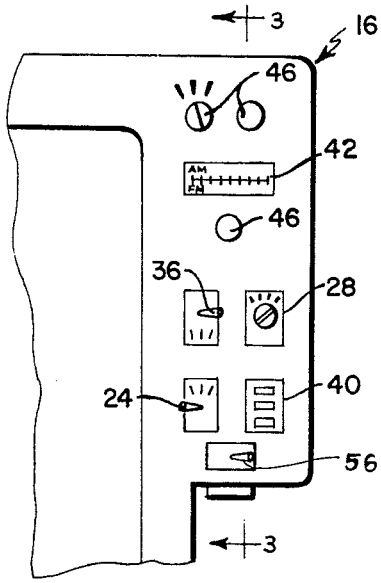
FIG. 2 is a top plan view, on an enlarged scale, of the unitary accessory control of FIG. 1.

Referring now to the drawings, FIG. 1 shows an exemplary waterbed 10 having a flexible bladder 12 within which the body supporting fluid is contained. The perimeter of the bladder 12 is supported by a frame 14. The unitary accessory control 16 of this invention is attached to the mattress support, such as being integrally formed with the frame 14 (see FIG. 2). While this arrangement is typical for waterbeds, the unitary accessory control 16 may be used with any other waterbed construction, such as when the bladder is surrounded by an air chamber, the primary requisite being that the control can be attached to the support for the mattress at a location to be readily accessible to the user of the waterbed.

Figure 3:
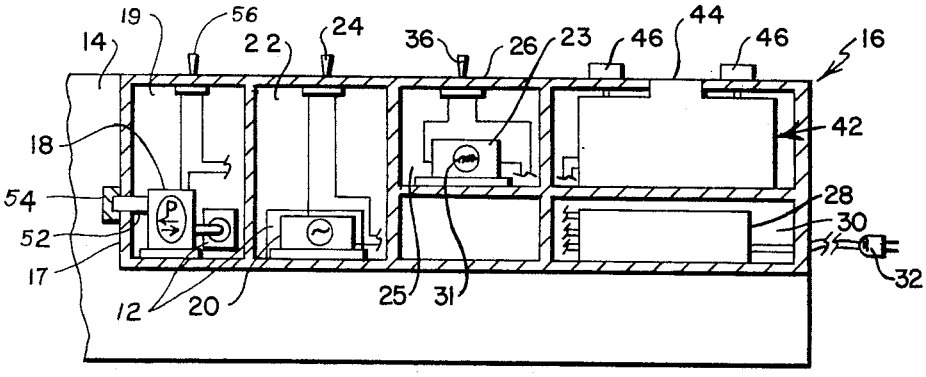
FIG. 3 is a side elevational view, partly in section, of the unitary accessory control taken along lines 3—3 of FIG. 2, portions being shown schematically to facilitate viewing.

The unitary accessory control 16 includes a housing 18 comprising a series of compartments or chambers (see FIG. 3). Within each of the respective chambers is a particular accessory for augmenting or improving the fundamental rest giving qualities of the waterbed 10. The accessories can be divided into two basic categories: (1) Those effecting control of the waterbed per se, and (2) those effecting control of the environment in which the bed is located. Medical studies have shown that aids to sleep in both categories add substantial benefit to the mental and physical well being of the sleeper.

In the first category, the accessories may include a pump 18 located in a first chamber 19, an oscillatory motor 20 located within a second chamber 22 and a fluid heater 23 located in a third chamber 25. The pump 18 is of the reversible type so as to function to either full or empty the bladder 12 of the waterbed 10. One side of the pumps 18 has a connection 50 to the bladder while the other side has a connection 52 accessible through the wall of the housing 17. The connection 52, which may be coupled to a filled or drained hose is normally closed by a cap 54. A remote switch 56 on the upper face 26 of the housing 17 is interconnected with an electronic power pack 28 in the chamber 30. The power pack 28 supplies motive power to the pump 18 through batteries or through a standard connection 32 to a wall outlet (not shown). Thus the switch 56 may be conveniently actuated to selectively initiate filling or emptying of the bladder.

The oscillatory motor 20, which communicates directly with the flexible bladder 12 of the waterbed through opening 58 in the housing 17 is connected to a remote switch 24 on the upper face 26 of the housing 17. The switch 24 is in turn connected to the electronic power pack 28. Thus, when the switch 24 is activated the oscillatory motor 20 will vibrate the flexible bladder 12 to impart motion to the fluid with the bladder. As noted above, medical studies have shown that vibratory motion within the fluid of the waterbed is very beneficial to rest. The fluid heater 23 may, for example, include a resistive element 31 (shown schematically) to directly heat the fluid in the bladder 12 or a pad covering the bladder. The heater 23 is connected to a switch 36 on the upper face 26 of the housing 17 and to the power pack 28 so that the temperature of the fluid in the waterbed can be regulated. Regulation of the temperature permits the user to tailor the temperature of the sleep surface to his immediate desires and adds beneficial pleasure to his rest period.

In the second category, the accessories may include room heat/airconditioning controls 28, lighting control switches 40, and sound producing equipment 42. The unitary accessory controls 28 are interconnected, either directly or by remote control, through the power pack 28 to the heating and airconditioning system of the room in which the waterbed 10 is located. The user can thus tailor the temperature of the room as well as the temperature of the sleep surface. The lighting control switches 40 are interconnected either directly or by remote control to regulate the lighting within the room to the immediate desires of the user. Control of room temperature and lighting have obvious desirable beneficial effects on the rest period of the user. The sound producing equipment 42 may be as simple as a single rest inducing tone generator or as complex as a multiplex AM/FM stereo radio and tape deck. In FIG. 3, a radio 44 has been illustrated, the radio having control knobs 46 in the upper face 26 of the housing 17 and being connected to the power pack 28. This additionally gives the user beneficial control and individual modification of his rest period.

From the foregoing, it is apparent that there is herein provided a unitary accessory control for a waterbed which beneficially extends the rest giving qualities of the waterbed. The unitary accessory control includes mechanisms for filling (emptying) the waterbed and for regulating both the sleep surface per se as well as the environment in which the waterbed is located. By making the unitary accessory control integral with the waterbed frame, the user of the bed has all the necessary added rest producing functional controls at his fingertips for immediate adjustment and regulation.

The invention has been described in detail with particular reference to a preferred embodiment thereof, but it will be understood that variations and modifications can be effected within the spirit and scope of the invention.

I claim:

1. In combination with a frame for supporting the perimeter of a fluid containing flexible bladder of a waterbed, a unitary accessory control comprising: a housing attached to said frame, a series of chambers in said housing, first accessory means located in a first of said series of chambers for producing sound, second accessory means located in a second of said series of chambers for regulating the environment surrounding said waterbed, third accessory means located in a third of said series of chambers for regulating the physical properties of said waterbed, and control means accessible from the exterior of said housing for controlling said first, second and third accessory means.

2. The invention of claim 1 wherein said first accessory means includes a signal generator for producing an audible signal conducive to sleep.

3. The invention of claim 2 wherein said first accessory means further includes a radio.

4. The invention of claim 1 wherein said second accessory means includes temperature and/or lighting environmental regulators.

5. The invention of claim 1 wherein said third accessory means includes a resistive heater means operatively associated with said flexible bladder of said waterbed for regulating the temperature of the fluid within the flexible bladder.

6. The invention of claim 5 wherein said third accessory means further includes a vibratory means operatively associated with said flexible bladder of said waterbed for imparting vibratory motion to the fluid within the flexible bladder.

7. The invention of claim 5 wherein said third accessory means further includes a reversible fluid pump connected to said flexible bladder of said waterbed for selectively filling or emptying said flexible bladder.

* * * * *